US006977560B2

(12) United States Patent
Itoh et al.

(10) Patent No.: US 6,977,560 B2
(45) Date of Patent: Dec. 20, 2005

(54) INPUT/OUTPUT COUPLING STRUCTURE FOR DIELECTRIC WAVEGUIDE RESONATOR

(75) Inventors: Kazuhiro Itoh, Hiki-Gun (JP); Kazuhisa Sano, Hiki-Gun (JP)

(73) Assignee: Toko, Inc., Tokyo (JP)

( * ) Notice: Subject to any disclaimer, the term of this patent is extended or adjusted under 35 U.S.C. 154(b) by 0 days.

(21) Appl. No.: 10/726,924

(22) Filed: Dec. 3, 2003

(65) Prior Publication Data

US 2004/0119564 A1 Jun. 24, 2004

(30) Foreign Application Priority Data

Dec. 6, 2002 (JP) ..... 2002-355065

(51) Int. Cl.[7] ..... H01P 5/08
(52) U.S. Cl. ..... 333/26; 333/230
(58) Field of Search ..... 333/21 R, 26, 333/208, 238, 239, 252, 248, 212, 230

(56) References Cited

U.S. PATENT DOCUMENTS

| | | | | |
|---|---|---|---|---|
| 4,725,798 | A * | 2/1988 | Igarashi | 333/212 |
| 5,422,611 | A * | 6/1995 | Kashima et al. | 333/26 |
| 5,926,079 | A | 7/1999 | Heine et al. | |
| 6,020,800 | A | 2/2000 | Arakawa et al. | |
| 2004/0145426 | A1 * | 7/2004 | Wu et al. | 333/26 |

FOREIGN PATENT DOCUMENTS

JP 2002-208806 7/2002

OTHER PUBLICATIONS

Dominic Deslandes et al., "Integrated Microstrip and Rectangular Waveguide in Planar Form", IEEE Microwave and Wireless Components Letters, vol. 11, No. 2, pp. 68-70, Feb. 2001.

* cited by examiner

*Primary Examiner*—Seungsook Ham
(74) *Attorney, Agent, or Firm*—Cohen, Pontani, Lieberman & Pavane

(57) ABSTRACT

Disclosed is an input/output coupling structure for a dielectric waveguide resonator to be mounted on a printed circuit board, which comprises; a region defined in the printed circuit board and surrounded by a first conductive film formed on the front surface of the printed circuit board and connected to a microstrip line on the printed circuit board, a second conductive film formed on the back surface of the printed circuit board, and a conductive wall connecting the respective peripheries of the first and second conductive films; a first slot formed in the front surface of the region; and a second slot formed in a surface of the dielectric waveguide resonator which is disposed to be opposed to the region of the printed circuit board. The first and second slots are adapted to be disposed in opposed relation to one another. The coupling structure can achieve the connection between a dielectric waveguide resonator and a microstrip line without forming any input/output electrode on the resonator, to facilitate the application of the dielectric waveguide resonator to an electronic circuit even if it is intended to be used in millimetric-wave band.

4 Claims, 3 Drawing Sheets

INPUT/OUTPUT COUPLING STRUCTURE FOR DIELECTRIC WAVEGUIDE RESONATOR

FIELD OF THE INVENTION

The present invention relates to an input/output coupling structure between a microstrip line formed on a printed circuit board and a dielectric waveguide resonator, and more particularly to an input/output coupling structure for coupling between TEM mode in a microstrip line and TE mode in a dielectric waveguide resonator to perform the conversion between the modes.

BACKGROUND OF THE INVENTION

[Patent Publication]

Japanese Patent Laid-Open Publication No. 2000-208806

[Non-Patent Publication]

Dominic Deslandes and Ke Wu, Integrated Microstrip and Rectangular Waveguide in Planar Form, IEEE Microwave and Wireless Component Letters, Vol. 11, No. 2, 2001.

A dielectric waveguide resonator and a dielectric filter composed of a plurality of dielectric waveguide resonators coupled with each other constitute a circuit component having low-loss characteristics in microwave and millimetric-wave bands. A microstrip or coplanar line is widely used as a signal line for printed electronic circuit boards. In order to use a dielectric waveguide resonator as an electronic circuit component, it is required to connect the resonator to a microstrip or coplanar line in a simple structure (manner).

While there have been proposed some connecting structures between a microstrip line and a dielectric waveguide resonator, none of them has practicability in millimetric-wave band in excess of 30 GHz. The reasons for this difficulty include an extremely reduced size of a downsized dielectric waveguide resonator for millimetric-wave band. The previously proposed connecting structure for a dielectric waveguide resonator is designed such that an input/output electrode pattern to be connected to a microstrip line is formed on a part of the resonator. However, when the resonator is designed to comply with the use in millimetric-wave band, it has to be drastically downsized, which leads to considerable difficulty in forming the input/output electrode pattern to be connected to the microstrip line, on the surface of the dielectric substrate. Even if a very fine electrode could be formed on the surface of the dielectric substance, it is practically difficult to assure reliable connection between the fine electrode and a microstrip line, resulting in poor mass-productivity as a key factor against application of the dielectric waveguide resonator to electronic circuits.

SUMMARY OF THE INVENTION

In view of the above circumstances, it is an object of the present invention to provide a structure capable of connecting a dielectric waveguide resonator to a microstrip line without forming any input/output electrode on the resonator, to facilitate the application of the dielectric waveguide resonator to an electronic circuit even if it is intended to be used in millimetric-wave band.

In the present invention, the above object is achieved by forming slots, respectively, in the surface of a dielectric waveguide resonator and a conductive film connected with a microstrip line, and coupling the dielectric waveguide resonator with the microstrip line through these slots.

Specifically, the present invention provides an input/output coupling structure for a dielectric waveguide resonator to be mounted on a printed circuit board. The input/output coupling structure comprises; a region defined in the printed circuit board and surrounded by a first conductive film formed on the front surface of the printed circuit board and connected to a microstrip line on the printed circuit board, a second conductive film formed on the back surface of the printed circuit board, and a conductive wall connecting the respective peripheries of the first and second conductive films; a first slot formed in the front surface of the region; and a second slot formed in a surface of the dielectric waveguide resonator which is disposed to be opposed to the region of the printed circuit board. The first and second slots are adapted to be disposed in opposed relation to one another.

Electromagnetic energy propagated along microstrip line in the TEM mode is converted into TE mode energy through the mode conversion section. The TE mode energy generated in the conversion section is coupled with TE resonant mode in the dielectric waveguide resonator through the slots to allow the microstrip line to be connected to the resonator.

Any slot even having an extremely small size can be formed in the resonator only by partly removing the conductive film of the resonator without any difficulties. Thus, desired slots for input/output couplings can be formed even in a minute resonator for millimetric-wave band. The slot in the printed circuit board is not necessarily formed in the same shape and/or size as those of the slot in the dielectric waveguide resonator, but may be surposefully formed in a different shape and/or size therefrom.

In this case, even if some displacement is caused when the dielectric waveguide resonator is mounted on the printed circuit board, the coupling between the slots can be maintained at the same level to allow the variation in characteristics of an electronic circuit due to the displacement to be desirably reduced. In a dielectric waveguide filter having a multi-stage resonator connected threto, input/output couplings can be achieved by forming slots in the bottom surfaces of the first stage and last stage resonators, respectively.

Other features and advantages of the present invention will be apparent from the accompanying drawings and from the detailed description.

DESCRIPTION OF THE PREFERRED EMBODIMENT

Figure 1:
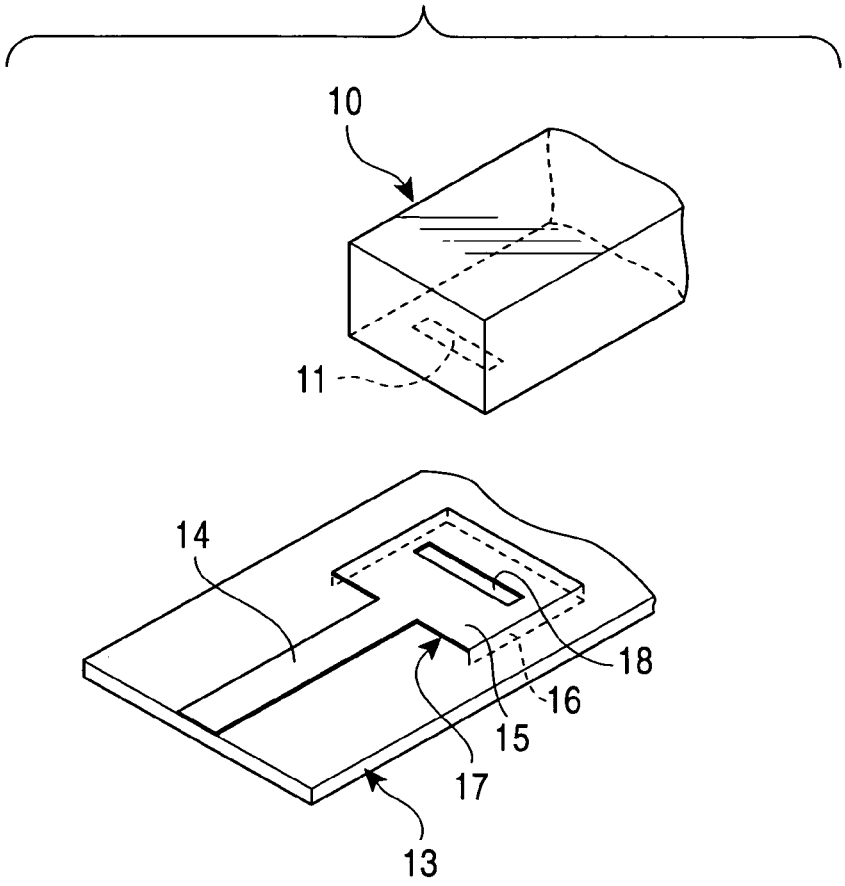
FIG. 1 is a perspective view showing a coupling structure according to one embodiment of the present invention.
Figure 2:
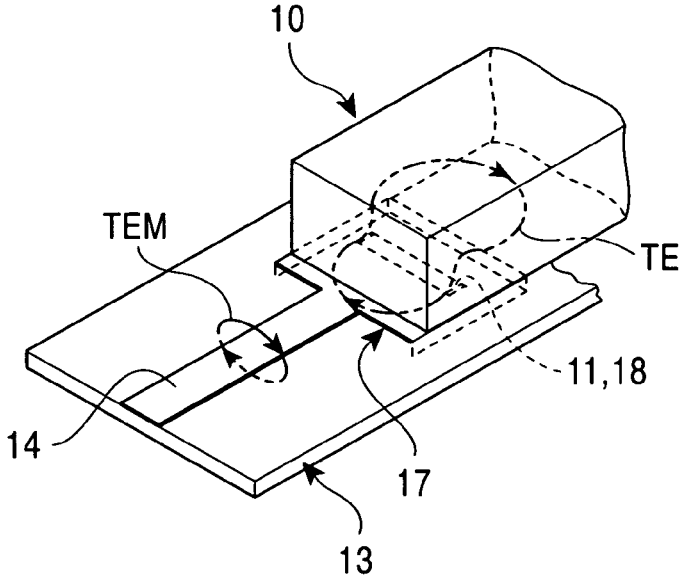
FIG. 2 is a perspective view showing the coupling structure according to the above embodiment.

With reference to the drawings, various embodiments of the present invention will now be described. FIG. 1 is a perspective view showing a coupling structure between a dielectric waveguide resonator and a microstrip line according to one embodiment of the present invention. A printed circuit board 13 is provided with a microstrip line 14 and a mode conversion section 17 connected with the microstrip line 14. The mode conversion section 17 is formed as a rectangular cavity. The three sides of the cavity are surrounded by a conductive wall 16, and one side connected with the microstrip line 14 has no conductive wall. A conductive film 15 for the mode conversion section 17 is formed on the front surface of the printed circuit board 13. A part of the conductive film 15 is removed to form a slot 18 therein. A dielectric waveguide resonator 10 has a bottom surface formed with a conductive film. A part of the conductive film of the resonator 10 is also removed to form a slot 11 therein. The slot 11 of the resonator 10 is adapted to be disposed in opposed relation to the slot 18 of the printed circuit board 13. Thus, when the dielectric waveguide resonator 10 is mounted on the printed circuit board 13 to cover over the slot 18, respective resonant modes in the printed circuit board 13 and the dielectric waveguide resonator 10, i.e. TE mode in the printed circuit board 13 and TE mode in the dielectric waveguide resonator 10, are coupled together. This state is shown in FIG. 2. Therefore, an energetic coupling is generated between the microstrip 14 and the dielectric waveguide resonator 10 to establish the connection therebetween. The slot 11 can be formed in the dielectric waveguide resonator only by partly removing the conductive film thereof. Thus, such a slot can be formed even in an extremely small resonator for millimetric-wave band without any difficulties.

Figure 3:
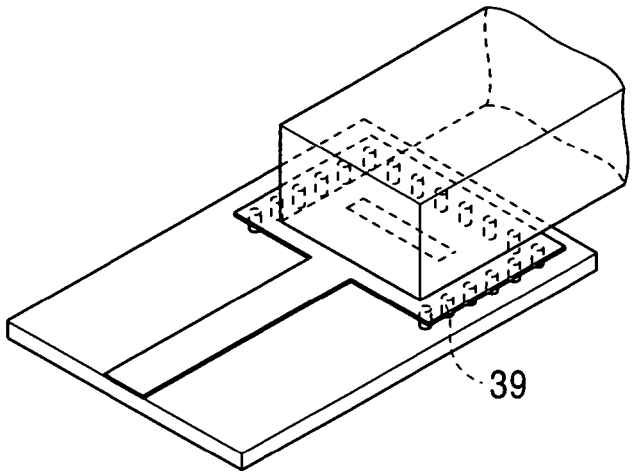
FIG. 3 is a perspective view showing a coupling structure according to another embodiment of the present invention.
Figure 4:
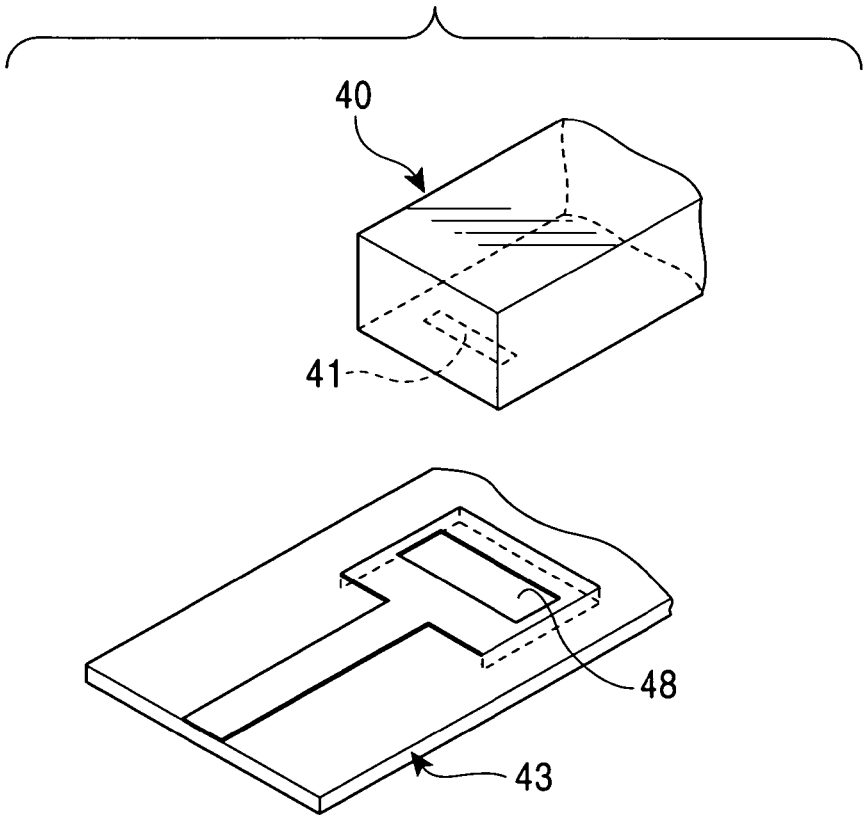
FIG. 4 is a perspective view showing a coupling structure according to still another embodiment of the present invention.

As shown in FIG. 3, an array of through-holes 39 filled with conductive material may be typically used as substitute for the conductive wall. Further, a slot in a printed circuit board is not necessarily formed in the same shape and/or size as those of a slot in the bottom surface of a dielectric waveguide resonator. For example, as shown in FIG. 4, a slot 48 formed in a printed circuit board 43 may be formed to have a larger size than that of a slot 41 formed in a dielectric waveguide resonator 40.

In this case, even if some displacement is caused when the dielectric waveguide resonator 40 is mounted on the printed circuit board 43, the coupling between the slots can be maintained at the same level to allow the variation in characteristics due to the displacement to be desirably reduced.

Figure 5:
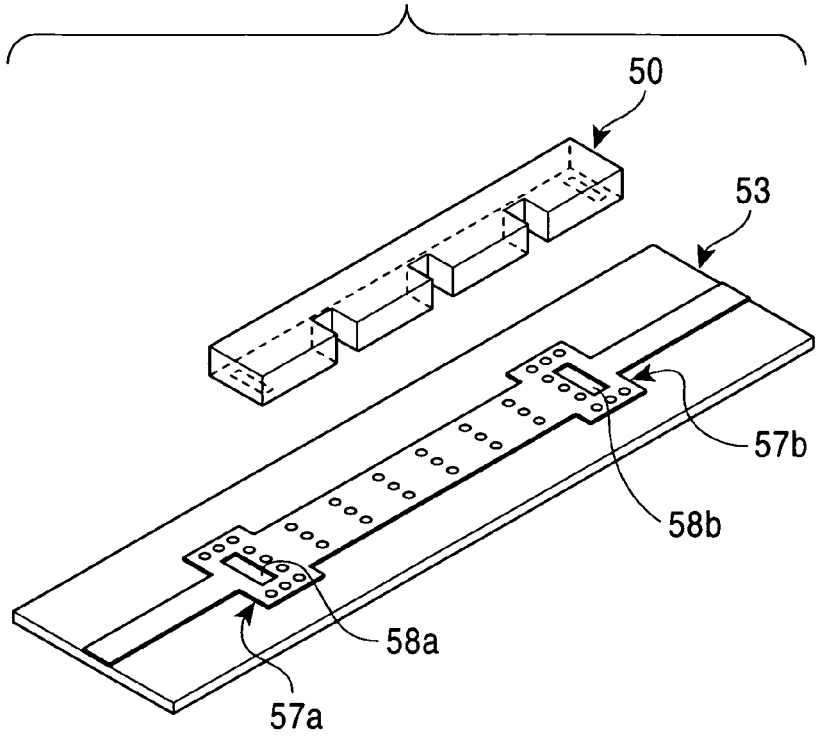
FIG. 5 is a perspective view showing a coupling structure according to yet another embodiment of the present invention.

FIG. 5 is a perspective view showing a connection structure for use in a dielectric waveguide filter, according to another embodiment of the present invention. Two mode conversion sections 57*a*, 57*b* serving, respectively, as input and output terminals are formed in a printed circuit board 53, and two slots 58*a*, 58*b* are formed, respectively, in the conversion sections 57*a*, 57*b*. Each of the conversion sections 57*a*, 57*b* has a conductive film connected to input or output microstrip line. While the conductive films are connected with one another, conductive walls are arranged to allow each of energies in the conversion sections 57*a*, 57*b* to be coupled with only a dielectric waveguide filter 50 or the microstrip line without problems. The conductive walls are also used to fix the dielectric waveguide filter 50 formed with a conductive film.

Figure 6:
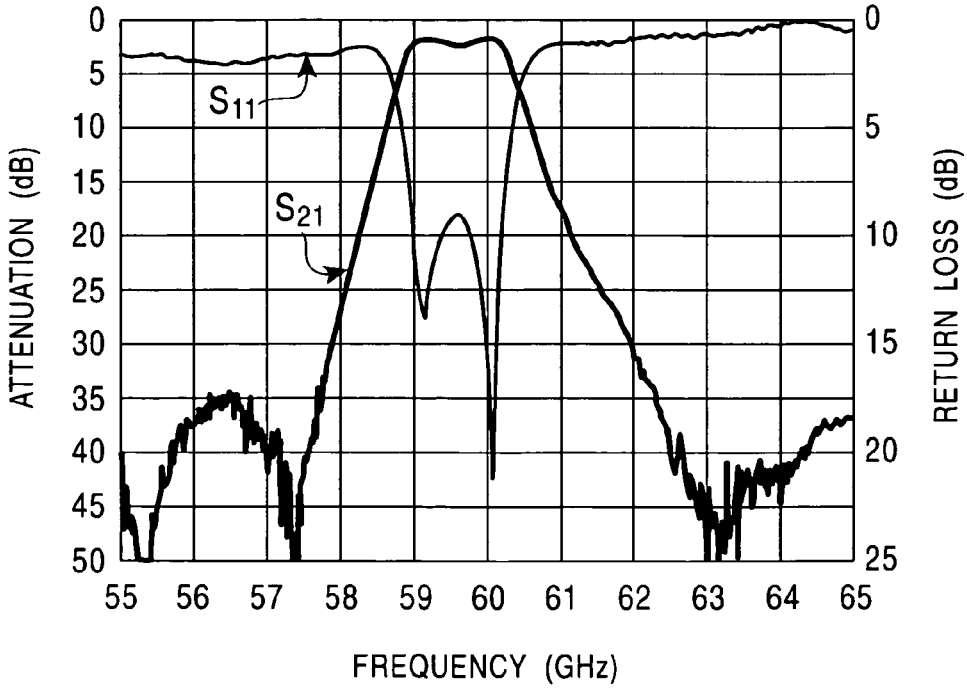
FIG. 6 is an explanatory diagram of the characteristic of a dielectric waveguide resonator having a connecting structure according to the present invention.

A dielectric waveguide filter having the structure as shown in FIG. 5 was actually fabricated using a dielectric material with a dielectric constant of 4.5 for an experiment. A rectangular-parallelepiped-shaped dielectric piece was first formed with 2 mm width, 1 mm a height and about 13 mm entire length. This piece was given three discontinuities and divided to four sections that act as resonators. Consequently, the piece of dielectric material forms a 4-stage dielectric waveguide filter. This dielectric waveguide filter was entirely covered with a conductive film except for two slots formed in the bottom surface thereof. A printed circuit board used in combination with the dielectric waveguide filter had a thickness of 0.254 mm and a dielectric constant of 2.2. The characteristic of the test model is shown in FIG. 6. The fabricated sample shows an excellent characteristic as proved by the fact that the peak value of the insertion loss in a pass band was 1.6 dB.

An advantageous embodiment of the present invention has been shown and described. It is obvious to the skilled in the art that various changes and modifications may be made therein without departing from the spirit and scope thereof as set forth in appended claims.

What is claimed is:

1. An input/output coupling structure for a dielectric waveguide resonator to be mounted on a printed circuit board, comprising:

a region defined in said printed circuit board, said region being surrounded by a first conductive film, a second conductive film and a conductive wall, said first conductive film being formed on the front surface of said printed circuit board and connected to a microstrip line on said printed circuit board, said second conductive film being formed on the back surface of said printed circuit board, said conductive wall connecting the respective peripheries of said first and second conductive films;

a first slot formed in the front surface of said region; and a second slot formed in a surface of said dielectric waveguide resonator, said surface of said dielectric waveguide resonator being disposed to be opposed to said region of said printed circuit board, wherein said first and second slots are adapted to be disposed in opposed relation to one another such that input/output coupling is formed by only said printed circuit board and said dielectric waveguide resonator.

2. The input/output coupling structure as defined in claim 1, wherein said conductive wall is formed of a plurality of through-holes filled with conductive material.

3. An input/output coupling structure for a dielectric waveguide resonator to be mounted on a printed circuit board, comprising:

a mode conversion region defined in said printed circuit board, said region being surrounded by a first conductive film, a second conductive film and a conductive wall, said first conductive film being formed on the front surface of said printed circuit board and connected to a TEM-mode microstrip line on said printed circuit board, said second conductive film being formed on the back surface of said printed circuit board, said conductive wall connecting the respective peripheries of said first and second conductive films;

a first slot formed in the front surface of said region; and a second slot formed in a surface of said dielectric waveguide resonator, said surface of said dielectric waveguide resonator being disposed to be opposed to said region of said printed circuit board, wherein said first and second slots are adapted to be disposed in opposed relation to one another to achieve TE mode coupling between only said printed circuit board and said dielectric waveguide resonator.

4. The input/output coupling structure as defined in claim 3, wherein said conductive wall is formed of a plurality of through-holes filled with conductive material.

* * * * *